US009463896B2

(12) United States Patent
Fitzwater

(10) Patent No.: US 9,463,896 B2
(45) Date of Patent: Oct. 11, 2016

(54) CARTON WITH OPENING FEATURE

(71) Applicant: Graphic Packaging International, Inc., Atlanta, GA (US)

(72) Inventor: Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/609,559

(22) Filed: Jan. 30, 2015

(65) Prior Publication Data

US 2015/0217897 A1 Aug. 6, 2015

Related U.S. Application Data

(60) Provisional application No. 61/965,492, filed on Jan. 31, 2014.

(51) Int. Cl.

| | |
|---|---|
| ***B65D 5/32*** | (2006.01) |
| ***B65D 5/56*** | (2006.01) |
| ***B31B 17/74*** | (2006.01) |
| ***B65D 5/54*** | (2006.01) |

(52) U.S. Cl.

CPC ..... *B65D 5/5425* (2013.01); *B31B 17/74* (2013.01); *B65D 5/32* (2013.01); *B65D 5/566* (2013.01)

(58) Field of Classification Search

CPC ..... B65D 5/32; B65D 5/5425; B65D 5/566; B65D 5/563; B31B 17/74

USPC ..... 229/117.28, 123.3

See application file for complete search history.

(56) References Cited

U.S. PATENT DOCUMENTS

| | | | |
|---|---|---|---|
| 1,772,625 | A | 8/1930 | Caulfield |
| 1,837,750 | A | 12/1931 | Becker |
| 1,842,237 | A | 1/1932 | Becker |
| 1,920,653 | A | 8/1933 | McLaughlin |
| 1,973,960 | A | 9/1934 | McLaughlin |
| 2,010,863 | A | 8/1935 | Johnson |
| 2,139,021 | A | 12/1938 | Johnson |
| 2,192,722 | A | 3/1940 | Vogt |
| 2,345,486 | A | 3/1944 | Nathan |

(Continued)

FOREIGN PATENT DOCUMENTS

| | | |
|---|---|---|
| CH | 412 695 | 4/1966 |
| CN | 102770353 | 11/2012 |

(Continued)

OTHER PUBLICATIONS

International Search Report and Written Opinion for PCT/US2015/013648 dated May 14, 2015.

*Primary Examiner* — Christopher Demeree
(74) *Attorney, Agent, or Firm* — Womble Carlyle Sandridge & Rice, LLP

(57) ABSTRACT

A package for holding an article, the package includes a liner and a construct attached to the liner. The liner includes an interior space for holding an article. The construct includes a plurality of panels that at least partially reinforce at a portion of the liner. The plurality of panels includes a top panel, a first side panel, a second side panel, and a bottom panel. The construct further includes a dispenser comprising dispensing features in at least one of the top panel and the bottom panel for allowing removal of the article from the package. The dispensing features include a dispenser panel at least partially defined by a tear line in the construct and for being at least partially removed to form a dispenser opening.

39 Claims, 14 Drawing Sheets

(56) References Cited

U.S. PATENT DOCUMENTS 2,355,665 A 8/1944 Mabee
2,361,984 A 11/1944 Williamson
2,365,159 A 12/1944 Walton
2,396,310 A 3/1946 Yungblut
2,437,926 A 3/1948 Ball
2,475,677 A 7/1949 Ringler
2,509,289 A 5/1950 Dunning
2,593,778 A 4/1952 McGinnis
2,634,897 A 4/1953 Bord
2,683,953 A 7/1954 Hopkins
2,701,678 A 1/1955 Read
2,738,916 A 3/1956 Peters
2,778,557 A 1/1957 Moore
2,820,585 A 1/1958 Nerenberg et al.
2,862,649 A 12/1958 Bergstein
2,973,086 A 2/1961 Thompson
2,989,224 A 6/1961 Umanoff
3,017,065 A 1/1962 Collie
3,021,002 A 2/1962 Reynolds
3,033,362 A 5/1962 Marcalus
3,085,733 A 4/1963 Umanoff
3,127,082 A 3/1964 Meyer-Jagenberg
3,133,688 A 5/1964 Asman
3,164,298 A 1/1965 Repko
3,250,436 A 5/1966 Kurtz
3,254,793 A 6/1966 Palmer
3,347,446 A 10/1967 Guyer et al.
3,355,089 A 11/1967 Champlin
3,363,822 A 1/1968 Maulini et al.
3,426,955 A 2/1969 Olson
3,486,682 A 12/1969 Whipperman et al.
3,580,466 A 5/1971 Thelen et al.
3,580,483 A 5/1971 Young
3,587,944 A 6/1971 Pehr
3,605,578 A 9/1971 Sternau
3,669,345 A 6/1972 Cole
3,680,766 A 8/1972 Collura et al.
3,690,544 A 9/1972 Meyers
3,744,702 A 7/1973 Ellison
3,764,058 A 10/1973 Forbes, Jr.
3,768,719 A 10/1973 Johnson
4,094,456 A 6/1978 Raccaforte
4,138,016 A 2/1979 Roccaforte
4,141,485 A 2/1979 Lambert
4,150,778 A 4/1979 Engdahl, Jr.
4,168,003 A 9/1979 Wysocki
4,194,677 A 3/1980 Wysocki
4,201,329 A 5/1980 Roccaforte
4,262,816 A 4/1981 Margulies
4,344,537 A 8/1982 Austin
4,361,270 A 11/1982 Roccaforte
4,411,365 A 10/1983 Horikawa et al.
4,484,683 A 11/1984 Werner, Jr.
4,508,218 A 4/1985 Focke et al.
4,512,476 A 4/1985 Herrington, Jr.
4,558,785 A 12/1985 Gordon
4,565,315 A 1/1986 Wagner et al.
4,572,423 A 2/1986 Spencer
4,584,202 A 4/1986 Roccaforte
4,609,142 A 9/1986 Adamek
4,645,108 A 2/1987 Gavin et al.
4,676,394 A 6/1987 Hiersteiner
4,738,265 A * 4/1988 Ritchart ..... A61B 5/0215 137/625.43
4,746,019 A 5/1988 Prater
4,768,703 A 9/1988 Sosler et al.
4,775,098 A * 10/1988 Peer, Jr. ..... B65D 5/708 229/123.3
4,782,788 A 11/1988 Arcand
4,863,052 A 9/1989 Lambert
4,905,898 A 3/1990 Wade
4,953,781 A 9/1990 Bryan
5,014,888 A 5/1991 Bryan
5,031,825 A 7/1991 Romagnoli
5,056,708 A 10/1991 Boyle et al.
5,078,273 A 1/1992 Kuchenbecker
5,105,971 A 4/1992 Hertenstein et al.
5,107,120 A 4/1992 Tom
5,110,042 A 5/1992 Hurden
5,141,150 A 8/1992 Plaessmann
5,145,091 A 9/1992 Meyers
5,147,272 A 9/1992 Richison et al.
5,147,480 A 9/1992 Lang
5,166,681 A 11/1992 Bottesch et al.
5,215,250 A 6/1993 Roccaforte
5,251,808 A 10/1993 Rudd
5,259,552 A 11/1993 Kuchenbecker
5,265,799 A 11/1993 Stone
5,292,058 A 3/1994 Zoss et al.
5,347,865 A 9/1994 Mulry et al.
5,356,022 A 10/1994 Tipps
5,363,981 A 11/1994 Giblin et al.
5,372,301 A 12/1994 Besson
5,429,297 A 7/1995 Walsh
5,445,316 A 8/1995 Roccaforte
5,531,325 A 7/1996 Deflander et al.
5,632,402 A 5/1997 Walsh et al.
5,632,404 A 5/1997 Walsh
5,660,324 A 8/1997 Rowland
5,668,539 A 9/1997 Patchell
5,678,755 A 10/1997 Block
5,680,986 A 10/1997 Botterman
5,746,871 A 5/1998 Walsh
5,783,030 A 7/1998 Walsh
5,794,811 A 8/1998 Walsh
5,794,812 A 8/1998 Walsh
5,857,614 A 1/1999 Walsh
5,876,317 A 3/1999 Sigrist et al.
5,918,799 A 7/1999 Walsh
5,960,555 A 10/1999 Deaton et al.
5,992,734 A 11/1999 Tokarski et al.
5,996,797 A 12/1999 Flaig
6,026,953 A 2/2000 Nakamura et al.
6,050,484 A 4/2000 Galomb
6,059,182 A 5/2000 Wein
6,062,467 A 5/2000 Ours et al.
6,102,277 A 8/2000 Krapohl, Sr.
6,109,517 A 8/2000 Cabrera
6,120,184 A 9/2000 Laurence et al.
6,145,736 A 11/2000 Ours et al.
6,152,360 A 11/2000 Block et al.
6,206,279 B1 3/2001 Countee
6,213,388 B1 4/2001 Ours et al.
6,227,440 B1 5/2001 Hart
6,328,472 B1 12/2001 Laurence et al.
6,336,584 B1 1/2002 Roch et al.
6,352,096 B1 3/2002 Walsh
6,364,202 B1 4/2002 Zelley
6,386,438 B1 5/2002 Walsh et al.
6,419,151 B1 7/2002 Urtubey
6,424,272 B1 7/2002 Gutta et al.
6,474,040 B1 11/2002 Ours et al.
6,478,216 B2 11/2002 Wiart
6,568,586 B1 5/2003 VanEsley
6,634,546 B2 10/2003 Heeley et al.
6,676,009 B1 1/2004 Rose
6,702,109 B1 3/2004 Tabuchi
6,753,766 B2 6/2004 Patchell
6,761,269 B2 7/2004 Hamming
6,767,604 B2 7/2004 Muir, Jr. et al.
6,854,639 B2 2/2005 Walsh
6,869,009 B2 3/2005 Sutherland et al.
6,889,892 B2 5/2005 Walsh et al.
6,918,532 B2 7/2005 Sierra-Gomez et al.
6,961,006 B2 11/2005 Harter, Jr. et al.
7,025,504 B2 4/2006 Olin
7,036,714 B2 5/2006 Walsh et al.
7,051,877 B2 5/2006 Lin
7,148,482 B2 12/2006 Harter, Jr.
7,210,612 B2 5/2007 Walsh et al.
7,253,722 B2 8/2007 Deasy et al.
7,407,087 B2 8/2008 DeBusk et al.
7,648,024 B2 1/2010 Mitten et al.
7,665,629 B2 2/2010 Julius et al.

(56) References Cited

U.S. PATENT DOCUMENTS

| | | | |
|---|---|---|---|
| 7,699,166 | B2 | 4/2010 | Gauger et al. |
| 7,699,214 | B2 | 4/2010 | Mestre et al. |
| 7,703,665 | B2 | 4/2010 | McGowan |
| 7,780,006 | B2 | 8/2010 | Clark, Jr. et al. |
| 7,938,312 | B2 | 5/2011 | Ford |
| 7,959,060 | B2 | 6/2011 | Wilson et al. |
| 7,984,844 | B2 | 7/2011 | Jones |
| 8,002,171 | B2 | 8/2011 | Ryan et al. |
| 8,066,137 | B2 | 11/2011 | Sanfilippo et al. |
| 8,231,024 | B2 | 7/2012 | Sanfilippo et al. |
| 8,418,885 | B2 | 4/2013 | Kasai |
| 8,534,537 | B2 | 9/2013 | House |
| 8,998,069 | B2 | 4/2015 | Woodham et al. |
| 9,156,582 | B2 | 10/2015 | Walsh et al. |
| 2001/0048022 | A1 | 12/2001 | Zoeckler |
| 2002/0036153 | A1 | 3/2002 | Yang |
| 2002/0055429 | A1 | 5/2002 | Walsh |
| 2003/0057266 | A1 | 3/2003 | Sedo |
| 2003/0136819 | A1 | 7/2003 | Walsh et al. |
| 2003/0144121 | A1 | 7/2003 | Walsh et al. |
| 2004/0007614 | A1 | 1/2004 | Saulas |
| 2004/0226989 | A1 | 11/2004 | Cook et al. |
| 2005/0109827 | A1 | 5/2005 | Martin |
| 2005/0127150 | A1 | 6/2005 | Walsh et al. |
| 2005/0150785 | A1 | 7/2005 | Julius et al. |
| 2005/0187087 | A1 | 8/2005 | Walsh |
| 2005/0211903 | A1 | 9/2005 | Harter, Jr. |
| 2005/0224564 | A1 | 10/2005 | Walsh |
| 2005/0274086 | A1 | 12/2005 | Petrelli et al. |
| 2005/0274782 | A1 | 12/2005 | Petrelli et al. |
| 2006/0049067 | A1 | 3/2006 | McDonald |
| 2006/0054675 | A1 | 3/2006 | Bennett |
| 2006/0067378 | A1 | 3/2006 | Rege et al. |
| 2006/0243783 | A1 | 11/2006 | Spivey, Sr. et al. |
| 2006/0255105 | A1 | 11/2006 | Sweet |
| 2006/0255106 | A1 | 11/2006 | Green |
| 2006/0255107 | A1 | 11/2006 | Wright |
| 2006/0255109 | A1 | 11/2006 | Green |
| 2006/0255113 | A1 | 11/2006 | McGowan |
| 2006/0266810 | A1 | 11/2006 | Foushee |
| 2007/0023436 | A1 | 2/2007 | Sierra-Gomez et al. |
| 2007/0131752 | A1 | 6/2007 | Jones |
| 2010/0002963 | A1 | 1/2010 | Holbert et al. |
| 2010/0019022 | A1 | 1/2010 | Ryan et al. |
| 2010/0140129 | A1 | 6/2010 | Sanfilippo et al. |
| 2011/0163100 | A1 | 7/2011 | Ueda et al. |
| 2011/0266298 | A1 | 11/2011 | Burgos Agudo |
| 2013/0001284 | A1 | 1/2013 | Hengami |
| 2013/0004626 | A1* | 1/2013 | Renders ..... B65D 33/02 426/121 |
| 2013/0256169 | A1 | 10/2013 | Bando et al. |
| 2014/0158690 | A1 | 6/2014 | Sumiyoshi et al. |
| 2014/0248402 | A1 | 9/2014 | Sierra-Gomez et al. |
| 2015/0151885 | A1 | 6/2015 | Nakano |

FOREIGN PATENT DOCUMENTS

| | | |
|---|---|---|
| DE | 29 23 455 | 12/1980 |
| DE | 81 10 323.9 | 9/1981 |
| DE | 33 07 758 | 9/1984 |
| DE | 87 08 078.8 | 10/1987 |
| DE | 43 08 047 | 12/1993 |
| DE | 93 20 241 5 | 3/1994 |
| DE | 94 13 813 | 10/1994 |
| DE | 10 2008 035 | 2/2010 |
| EP | 126 440 | 11/1984 |
| EP | 0 406 556 | 1/1991 |
| EP | 0 466 337 | 1/1992 |
| EP | 0 529 260 | 3/1993 |
| EP | 0 530 643 | 3/1993 |
| EP | 1 457 425 | 9/2004 |
| EP | 1 562 053 | 8/2005 |
| EP | 1 580 542 | 9/2005 |
| EP | 1 975 081 | 10/2008 |
| EP | 2 368 811 | 9/2011 |
| FR | 2 699 150 | 6/1994 |
| FR | 2 755 670 | 5/1998 |
| GB | 104445 | 3/1917 |
| GB | 385033 | 12/1932 |
| GB | 393199 | 6/1933 |
| GB | 1 242 356 | 8/1971 |
| GB | 1 489 963 | 10/1977 |
| GB | 1 584 066 | 2/1981 |
| GB | 2 363 372 | 12/2001 |
| JP | 2013-75691 A | 4/2013 |
| JP | 2013-249127 A | 12/2013 |
| WO | WO 95/28325 | 10/1995 |
| WO | WO 99/38779 | 8/1999 |
| WO | WO 00/12407 A1 | 3/2000 |
| WO | WO 00/74931 | 12/2000 |
| WO | WO 02/04302 | 1/2002 |
| WO | WO 2005/082738 | 9/2005 |
| WO | WO 2006/124643 | 11/2006 |
| WO | WO 2006/133401 | 12/2006 |
| WO | WO 2008/086272 | 7/2008 |
| WO | WO 2008/086388 | 7/2008 |
| WO | WO 2009/018400 | 2/2009 |

* cited by examiner

CARTON WITH OPENING FEATURE

CROSS-REFERENCE TO RELATED APPLICATION

This application claims the benefit of U.S. Provisional Patent Application No. 61/965,492, filed Jan. 31, 2014.

INCORPORATION BY REFERENCE

The disclosure of U.S. Provisional Patent Application No. 61/965,492, which was filed on Jan. 31, 2014, is hereby incorporated by reference for all purposes as if presented herein in its entirety.

BACKGROUND

The present disclosure generally relates to packages for holding products. More specifically, the present disclosure is directed to packages having a reinforcing sleeve with an opening feature for supporting and opening a bag.

SUMMARY

In one aspect, the present disclosure is generally directed to a package for holding an article. The package comprises a liner and a construct attached to the liner. The liner comprises an interior space for holding an article. The construct comprises a plurality of panels that at least partially reinforce at a portion of the liner. The plurality of panels includes a top panel, a first side panel, a second side panel, and a bottom panel. The construct further comprises a dispenser comprising dispensing features in at least one of the top panel and the bottom panel for allowing removal of the article from the package. The dispensing features include a dispenser panel at least partially defined by a tear line in the construct, the dispenser panel is for being at least partially separated from the construct along the tear line to form a dispenser opening.

In another aspect, the disclosure is generally directed to a construct in combination with a liner. The combination comprising the construct attached to the liner. The liner comprises an interior space for holding an article. The construct comprises a plurality of panels that at least partially reinforce a portion of the liner. The plurality of panels comprises a top panel, a first side panel, a second side panel, and a bottom panel. The construct further includes a dispenser comprising dispensing features in at least one of the top panel and the bottom panel for allowing removal of the article from the combination. The dispensing features comprise a dispenser panel at least partially defined by a tear line in the construct, the dispenser panel is for being at least partially separated from the construct along the tear line to form a dispenser opening.

In another aspect, the disclosure is generally directed to a method of forming a package. The method comprises obtaining a construct comprising a plurality of panels. The plurality of panels comprises a top panel, a first side panel, a second side panel, and a bottom panel. The construct further comprises a dispenser comprising dispensing features in at least one of the top panel and the bottom panel for allowing removal of an article from the package. The dispensing features comprise a dispenser panel at least partially defined by a tear line in the construct. The method further comprises attaching the construct to a liner, forming an interior space at least partially defined by the plurality of panels, and forming a dispenser opening by tearing along the tear line and at least partially separating the dispenser panel from the construct.

Additional aspects, features, and advantages of the present disclosure will become apparent from the following description and accompanying figures.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

Various features, advantages and aspects of the present invention may be set forth or apparent from consideration of the following description of the invention, taken in conjunction with the accompanying drawings. Moreover, it will be understood that the accompanying drawings, which are included to provide a further understanding of the present disclosure, are incorporated in and constitute a part of this specification, illustrate various aspects, advantages and benefits of the present disclosure, and, together with the following description, serve to explain the principles of the present invention and disclosure. In addition, those skilled in the art will understand that, according to common practice, various features of the drawings discussed below are not necessarily drawn to scale, and that dimensions of various features and elements of the drawings may be expanded or reduced to more clearly illustrate the embodiments of the present disclosure.

Corresponding parts are designated by corresponding reference numbers throughout the drawings.

DETAILED DESCRIPTION OF THE EXEMPLARY EMBODIMENTS

The present disclosure generally relates to cartons and packages for holding products, such as any suitable consumer product that is suitable for holding in a package or bag for quick access and use. Such products can include food products such as popcorn, candy, and snacks for infants, toddlers, children, or adults, or any other suitable food product. Also, non-food items such as towelettes, wipes, or any other suitable product, can be held in the package or bag. Packages according to the present disclosure can accommodate articles or containers of numerous different shapes and may also be used in microwave applications. In this specification, the terms "lower," "bottom," "upper," "top," "side," "front," and "back" indicate orientations determined in relation to fully erected cartons, and such terms are not intended to limit the scope of the disclosure.

Figure 1:
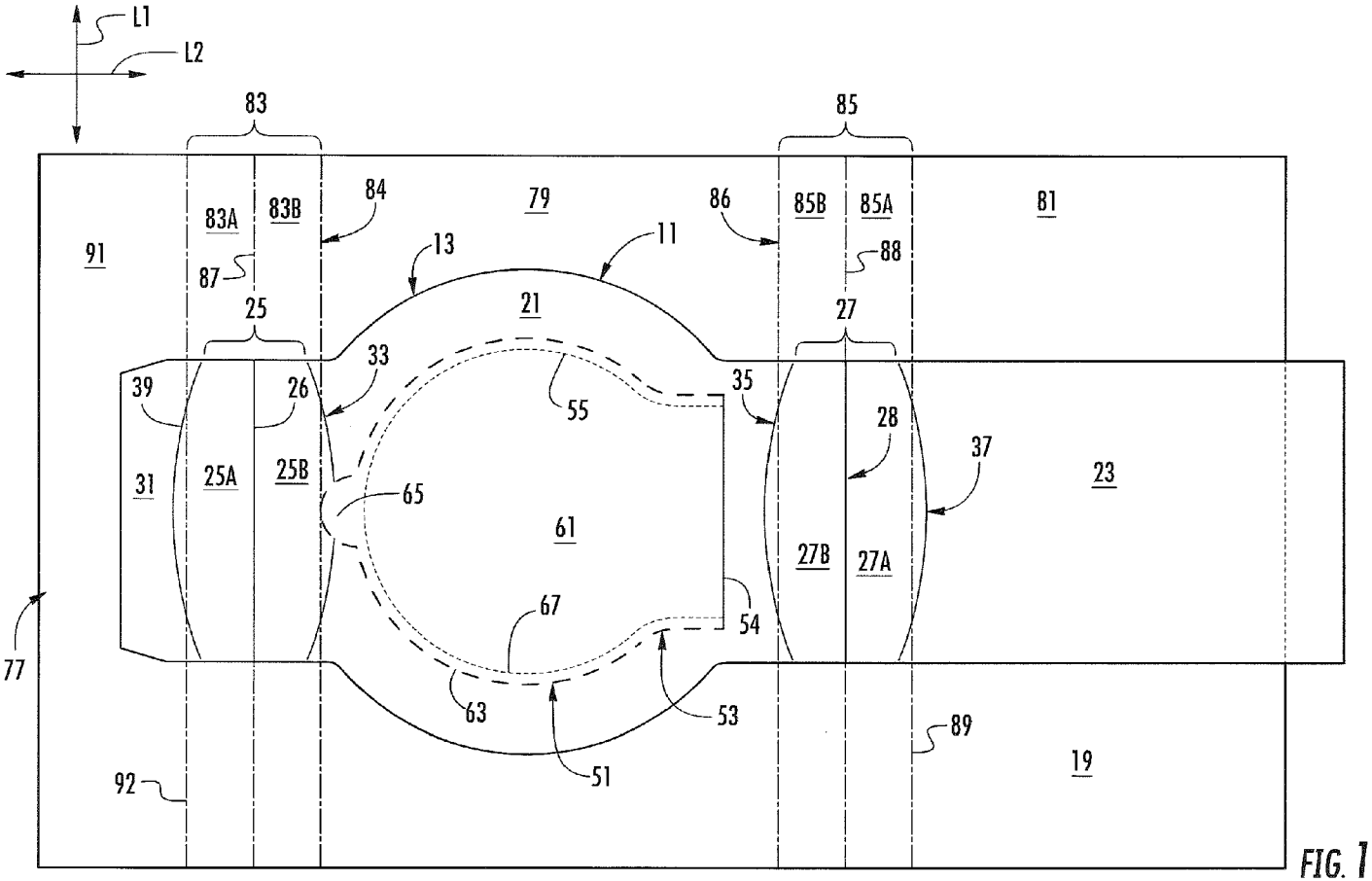
FIG. 1 is an exterior plan view of a blank for forming a carton according to a first embodiment of the disclosure.

FIG. 1 is a plan view of an exterior surface 11 of a blank 13 for forming a sleeve 15 (i.e., construct) for holding or being attached to a bag B or a liner 19 to reinforce a package 17 (FIG. 3), according to an embodiment of the disclosure. The blank 13 has a lateral axis L1 that extends generally in the direction of the width of the blank and a longitudinal axis L2 that extends generally in the direction of the length of the blank. In the illustrated embodiment, the blank 13 has a top panel 21 foldably connected to a first gusset side panel 25 and a second gusset side panel 27 along arcuate fold lines 33 and 35 respectively. The first gusset side panel 25 includes two individual panel portions (i.e., first portion and second portion) 25A, 25B foldably connected to one another along lateral fold line 26. The second gusset side panel 27 includes two individual panel portions (i.e., third portion and fourth portion) 27A, 27B foldably connected to one another along lateral fold line 28.

In one embodiment, a bottom panel 23 is foldably connected to the second gusset side panel 27 at a third arcuate fold line 37. As shown in FIG. 1, an attachment flap 31 is foldably connected to the first gusset side panel 25 at a fourth arcuate fold line 39. In one embodiment, the fold lines 33, 39 are spaced apart from and concave relative to lateral fold line 26. Similarly, the fold lines 35, 37 are spaced apart from and concave relative to lateral fold line 28. In alternative embodiments, the blank 13 can be otherwise shaped and can have alternative panel, flap, fold line, and/or panel portion arrangements. Furthermore, according to other embodiments, the fold lines 33, 35, 37, and 39 may be otherwise shaped, arranged, or configured and could be convex relative to the respective top and/or bottom panels, without departing from the disclosure.

According to one embodiment shown in FIGS. 1-4, the reinforced package 17 further includes a dispenser 51, including an outer dispensing feature 53 extending in the top panel 21 of the blank 13 and an inner dispensing feature 55 extending in the bag B or liner 19. The reinforced package 17 can include various dispensing features without departing from the disclosure. The outer dispensing feature 53 of the dispenser 51 can include a dispenser panel 61 foldably connected to the top panel 21 at lateral fold line 54 and defined by a tear line 63 extending in at least the top panel 21. In one embodiment, the lateral fold line 54 can be omitted and the dispenser panel 61 can be fully removed without departing from the disclosure. The dispenser panel 61 can include an access tab 65 for gripping to initiate tearing of the tear line 63. The dispenser panel 61 and access tab 65 can be alternatively shaped, arranged, and/or positioned without departing from the disclosure.

Referring to FIG. 1, the inner dispensing feature 55 of the dispenser 51 can include a cut line 67 extending in the bag B or liner 19 and defining an inner dispenser panel 69 (see FIG. 5A) that can be aligned with the outer dispensing feature 53. The cut line 67 can be a generally continuous cut in the liner 19 extending through the entire thickness of the liner substantially along the entire length of the cut line 67. The cut line 67 can have some polymer bridging, nicks, or other formations weakly connecting the inner dispenser panel 69 to the remainder of the liner 19 as a consequence of imperfections in the cutting process or by design. The cut line 67 can be formed in the bag B or liner 19 by a software-driven laser cutting system or other laser system, a rule die cutting tool or other mechanical cutting system, heat stamping, or any other suitable method. The inner dispensing feature 55 can be alternatively formed in the bag B or liner 19 without departing from the disclosure.

Figure 1A:
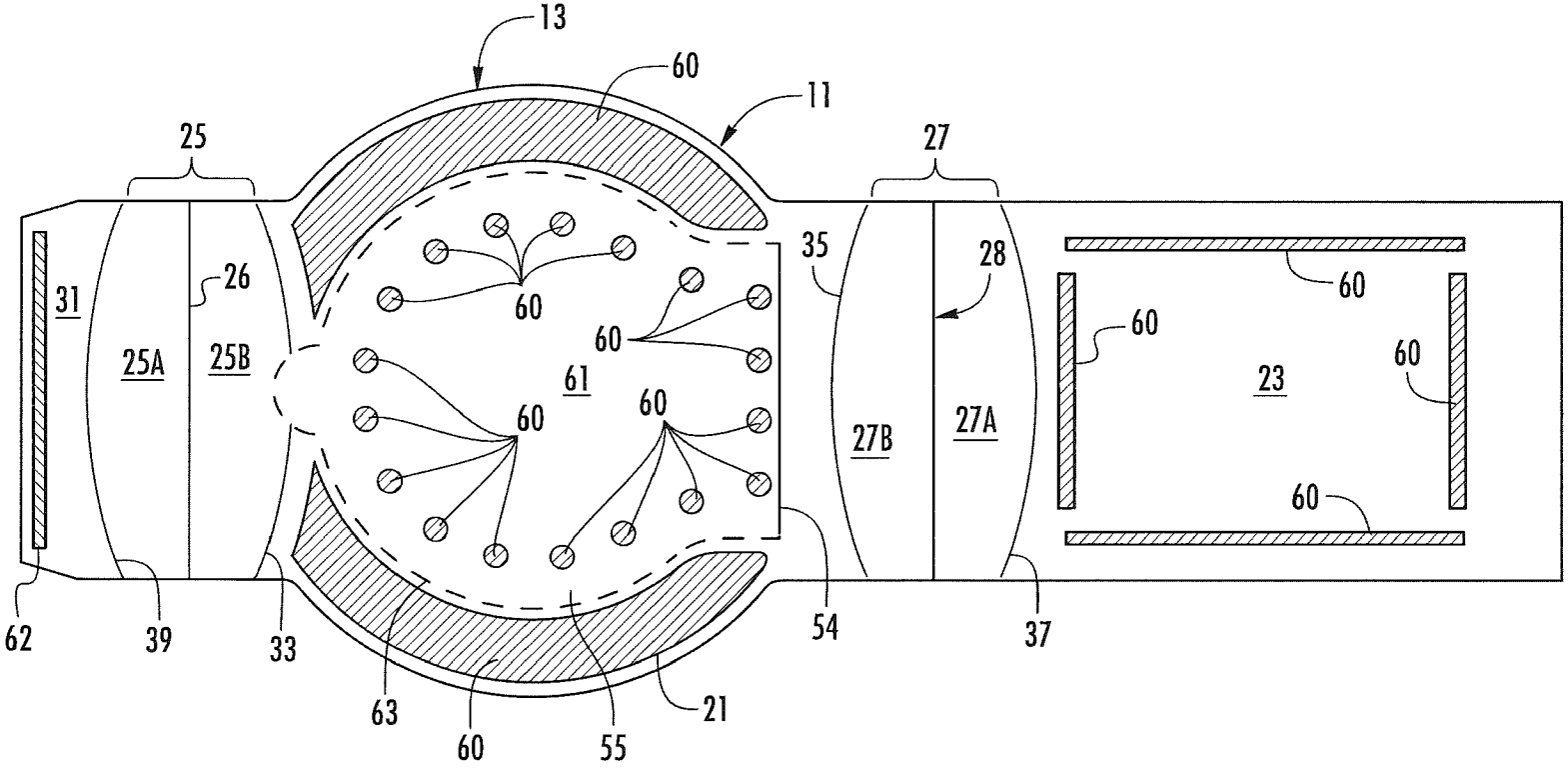
FIG. 1A is an interior plan view of the blank of FIG. 1.

In one embodiment as illustrated in FIG. 1A, the blank 13 includes adhesive regions 60 on the top panel 21, and bottom panel 23, for receiving adhesive and being fixedly attached to an exterior surface of the bag B. Additionally, the blank 13 can include an adhesive region 62 on the attachment flap 31 for receiving adhesive and being fixedly attached to an interior surface of the back panel 23. The adhesive regions 60, 62 can be otherwise arranged, shaped, modified, or omitted without departing from the scope of this disclosure.

As illustrated in FIG. 1, a plan view of an exterior surface 77 of the blank or liner material 19 for forming a bag B of the reinforced package 17 is illustrated. The blank or liner material 19 may include a top panel 79 foldably connected to a first side panel 83 along a first fold line 84 and foldably connected to a second side panel 85 along a second fold line 86. The first side panel 83 includes two individual panel portions 83A, 83B foldably connected to one another along lateral fold line 87. Similarly, the second side panel 85 includes two individual panel portions 85A, 85B foldably connected to one another along lateral fold line 88. A bottom panel 81 can be foldably connected to the second side panel 85 at a third fold line 89. An attachment panel 91 can be foldably connected to the first side panel 83 at a fourth fold line 92. In one embodiment, the inner dispensing feature 55 is defined by cut lines 67 in the top panel 79.

In one embodiment, the fold lines 84, 92 are spaced apart from lateral fold line 87. Similarly, the fold lines 86, 89 are spaced apart from lateral fold line 88. In alternative embodiments, the liner 19 can be otherwise shaped and can have alternative panel, flap, fold line, and/or panel portion arrangements, for instance, the bottom panel 81 may be foldably connected to the first side panel 83 and the attachment panel 91 may be foldably connected to the second side panel 85 without departing from the disclosure. Furthermore, according to other embodiments, the fold lines 84, 86, 89, and 92 may be otherwise shaped, arranged, or configured and could be segmented fold lines or arcuate fold lines without departing from the disclosure.

In one embodiment, at least a portion of the liner 19 may have an element (not shown) for use in cooking, heating, browning, and/or shielding (e.g., a microwave energy interactive element, such as, but not limited to, a susceptor) mounted thereto. The susceptor may be of flexible susceptor material. Further the susceptor could be solid or patterned without departing from the spirit of the disclosure.

In one exemplary method of forming the blank 13 into the reinforced package 17, the top panel 21 of the blank 13 is first placed on the exterior surface of the bag B or liner 19. The outer dispensing feature 53 is aligned with the inner dispensing feature 55 as illustrated in FIG. 1 such that the outer dispensing feature 53 circumscribes the inner dispensing feature 55. The top panel 21 and dispenser panel 61 are then adhered to the bag B or liner 19 at adhesive regions 60. The bottom panel 81 and the portion 85A of side panel 85 may be folded along fold line 88, and the attachment panel 91 and the portion 83A of the side panel 83 may be folded along fold line 87, such that the bottom panel 81 is overlapped and/or brought into registration with the attachment panel 91. On of the ends 71, 72 of the bag B (FIG. 3) can be sealed along the edges to form a bag with one open side. Alternatively, both ends 71, 72 may remain open without departing from the disclosure. The blank 13 may be folded about fold lines 26, 28 (e.g., concurrently with the liner or after the folding of the liner 19) to create a reinforcing sleeve formation. For example, attachment flap 31 may be overlapped and/or brought into registration with the bottom panel 23 such that the bottom panel 23 at least partially overlaps the attachment flap 31 and is attached to the attachment flap 31 at adhesive region 62 as illustrated in FIG. 1A. During this sequence, the blank 13 or reinforcing sleeve is attached to the bag B through adhesive regions 60.

Figure 2:
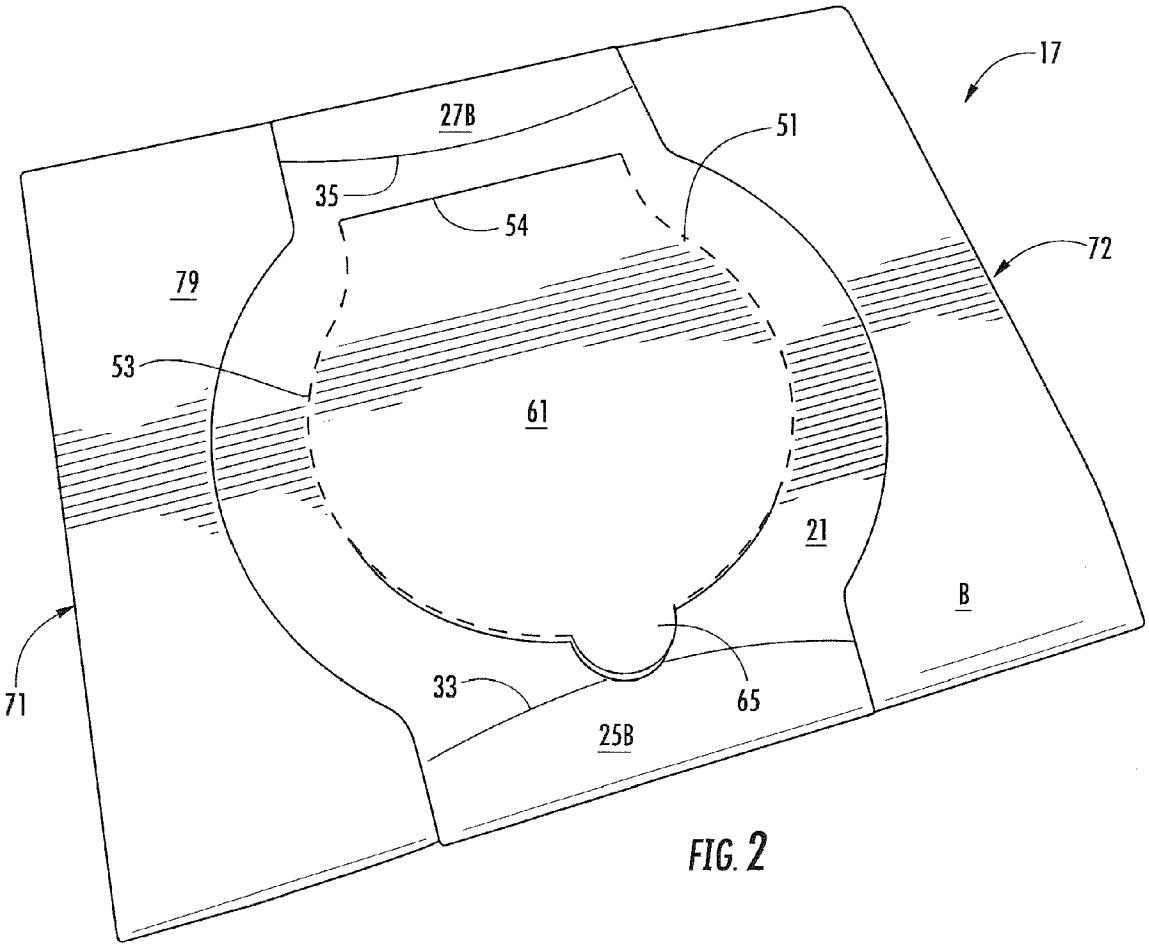
FIG. 2 is a perspective view of a carton formed from the blank of FIG. 1 in a non-erected configuration according to one embodiment of the disclosure.

Upon folding the bottom panel 23 and attachment flap 31, a reinforcing package 17 exists in a first, non-erected position (e.g., substantially flat or semi-flat position), as illustrated in FIG. 2. In this first position, the individual panel portions 25A, 25B, 27A, and 27B may be generally or at least partially in face-to-face registration. The first, non-erected position illustrated reduces and/or minimizes a volume of an interior space 42 of the bag B such that the reinforced package is in a non-erected or semi-flattened state. The non-erected state may facilitate easy stacking of a plurality of packages into, for example, a shipment container and subsequent organization at a destination facility. However, as illustrated in FIG. 2, the non-erected state may still facilitate the filling of the interior volume at least partially with a product. Thereafter, the interior volume 42 may be sealed in any feasible manner.

Figure 3:
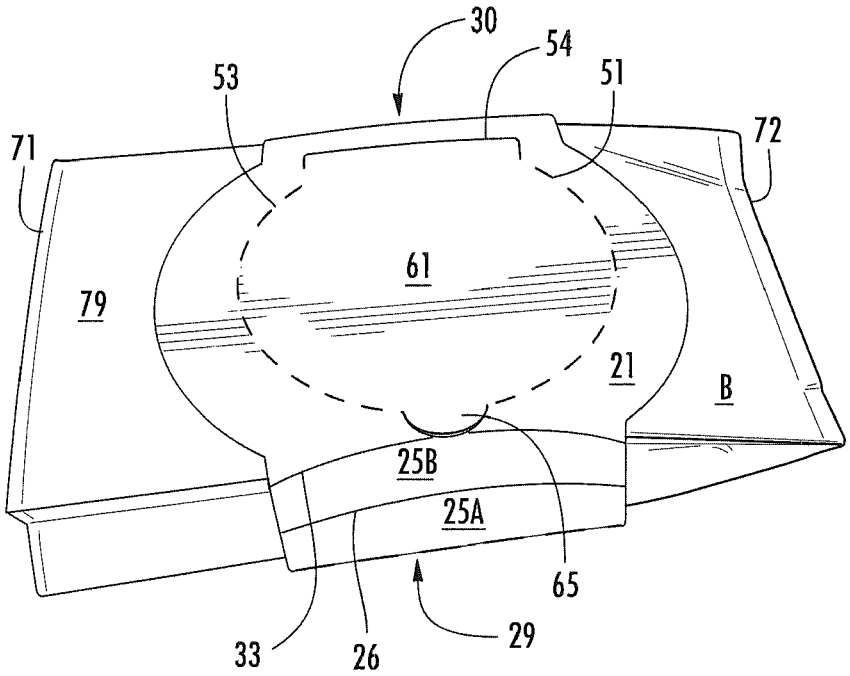
FIG. 3 is a perspective view of a partially closed carton formed from the blank of FIG. 1.
Figure 3A:
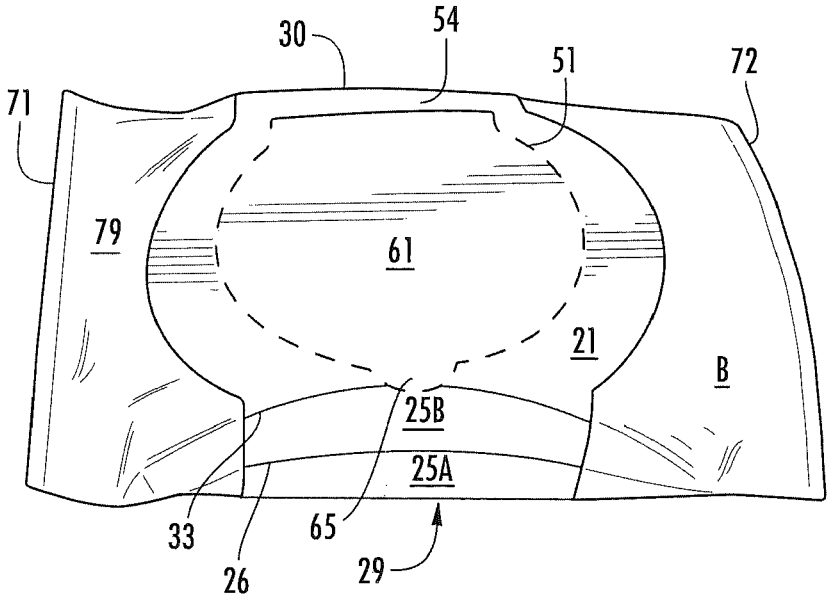
FIG. 3A is a perspective view of the carton formed from the blank of FIG. 1.
Figure 4:
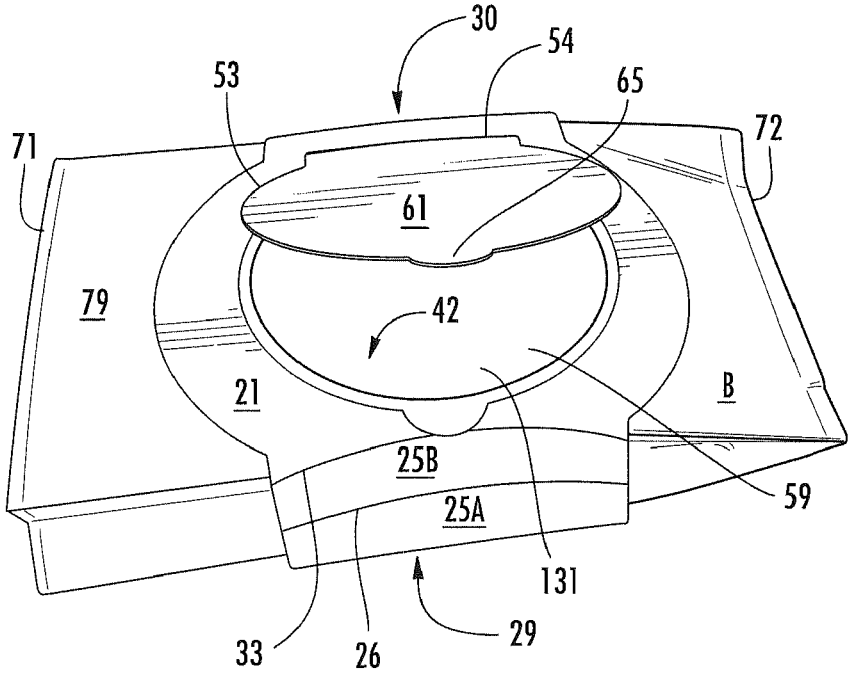
FIG. 4 is a perspective view of the carton of FIG. 3A in an open configuration.

Upon receipt of a reinforced package 17 in the first, non-erected position (with or without a sealed interior volume), the individual panel portions 25A, 25B, 27A, and 27B may be flexed or positioned to form first and second sides 29, 30 of the package in a second, erected position of the package as illustrated in FIGS. 3-4. The second, erected position, increases and/or maximizes a volume of the interior space 42. Other intervening states of the package 17 including intermediate states whereby the package is not fully erected are also applicable according to some embodiments. Furthermore, automatically erecting reinforced packages 17 are also applicable, for example, if bag B is filled with an expanding food product such as popcorn which expands when heated to at least partially form side panels 25, 27 during the cooking process.

As shown in FIG. 4 the dispenser 51 can be opened by grasping the access tab 65 of the dispenser panel 61 and tearing the dispenser panel 61 and inner dispenser panel 69 along tear lines 63 and 67 to form a dispenser opening 131. Product (not shown) can be removed from the dispenser opening 131 by a consumer. Alternatively, the dispenser 51 may comprise one or more dispenser and dispenser openings or the dispenser could be otherwise configured to have one or more openings of other shapes and sizes. Further, the dispenser 51 could alternatively include one or more dispenser panels to allow the user to remove containers through dispenser opening(s) in the side panels without departing from the disclosure. Also, the dispenser 51 could comprise one or more dispenser panels that comprise at least a portion of the bottom panel 23 without departing from the disclosure.

Figure 5:
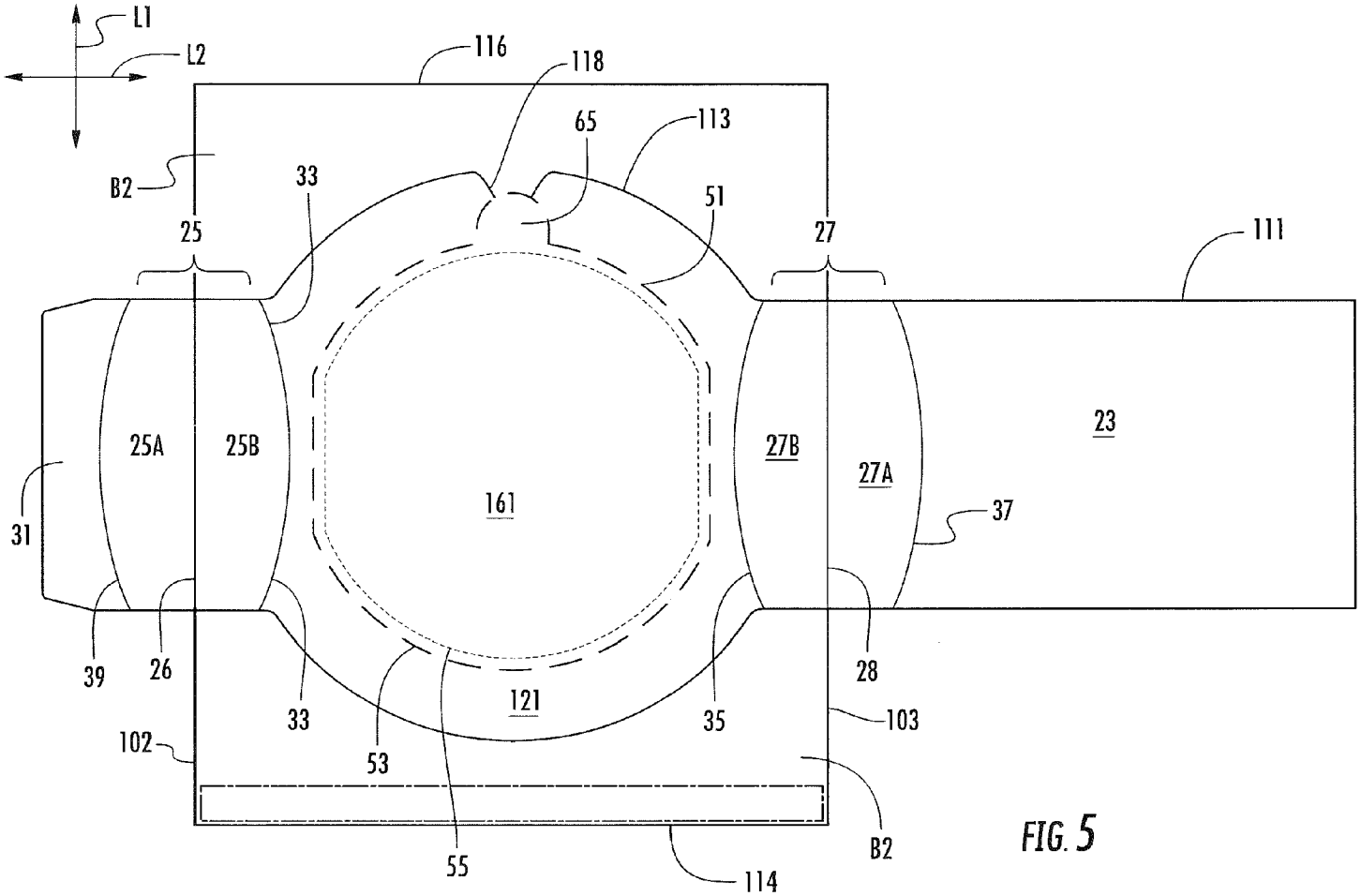
FIG. 5 is an exterior plan view of a blank for forming a carton according to another embodiment of the disclosure.

FIGS. 5-9 illustrate an alternative embodiment of the disclosure that is similar to the previously described embodiment, with like or similar features having like or similar reference numbers. FIG. 5 is a plan view of an exterior surface 111 of a blank 113 and a liner 119 for forming a bag 19 of the reinforced package 117. The top panel 121 may have an access cutout 118 aligned with and for access to the access tab 65. The liner 119 may be attached to the blank 113 and formed into a package or alternatively the liner 119 may be preformed into a bag 19 before the blank 113 is attached. The bag 19 may have a sealed end 114, an open end 116 or any combination thereof.

Figure 5A:
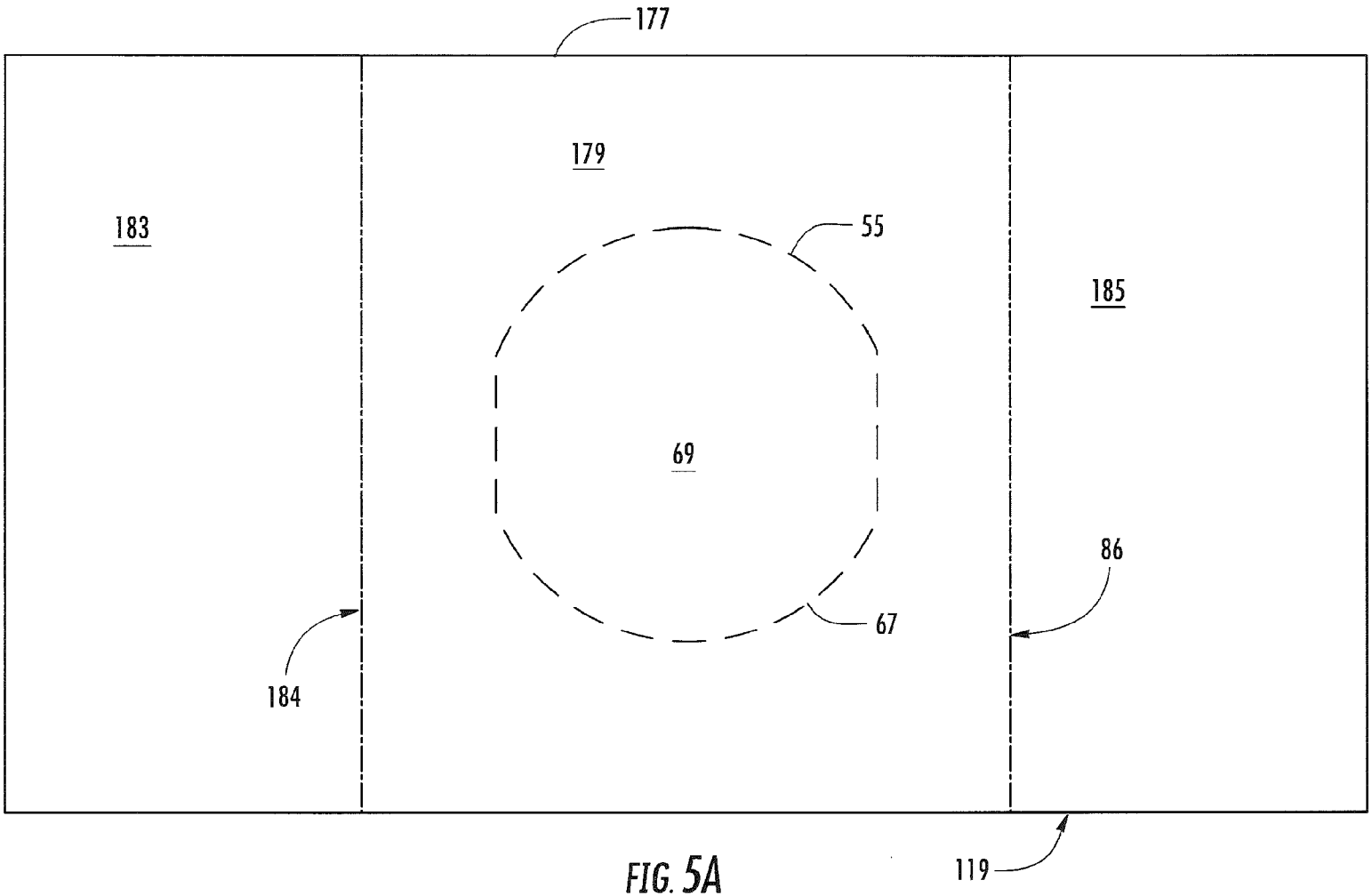
FIG. 5A is an exterior plan view of a liner according to one embodiment of the disclosure.

As illustrated in FIG. 5A, a plan view of an exterior surface 177 of the liner material 119 for forming a bag 19 of the reinforced package 117 is illustrated. The liner material 119 may include a top panel 179 foldably connected to a first panel 183 along a first fold line 184 and a second panel 185 along a second fold line 86. In one embodiment, the inner dispensing feature 55 is defined by cut lines 67 in the top panel 179 of the liner 119.

Figure 6:
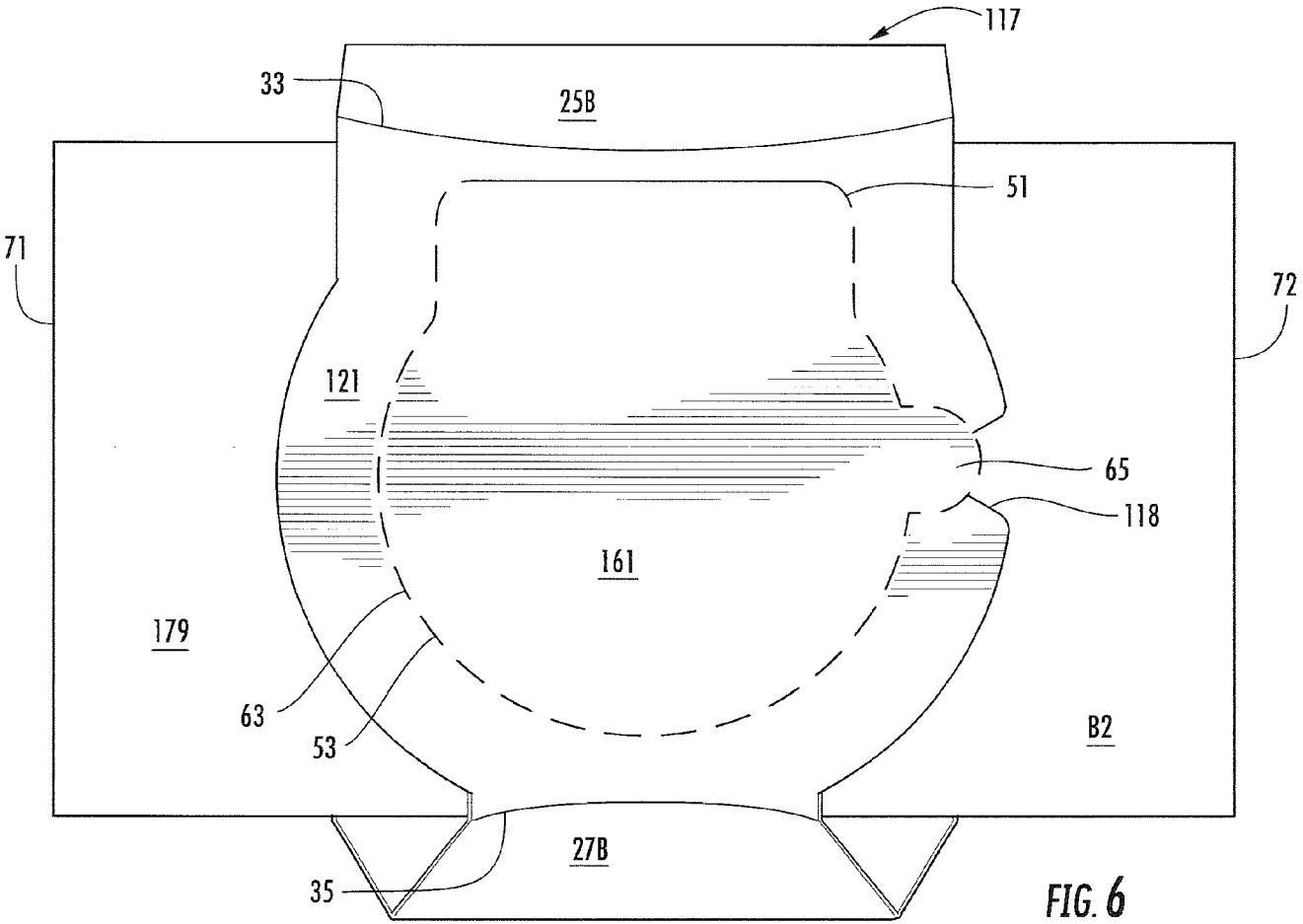
FIG. 6 is a perspective view of a carton formed from the blank of FIG. 5 in a non-erected configuration according to one embodiment of the disclosure.
Figure 7:
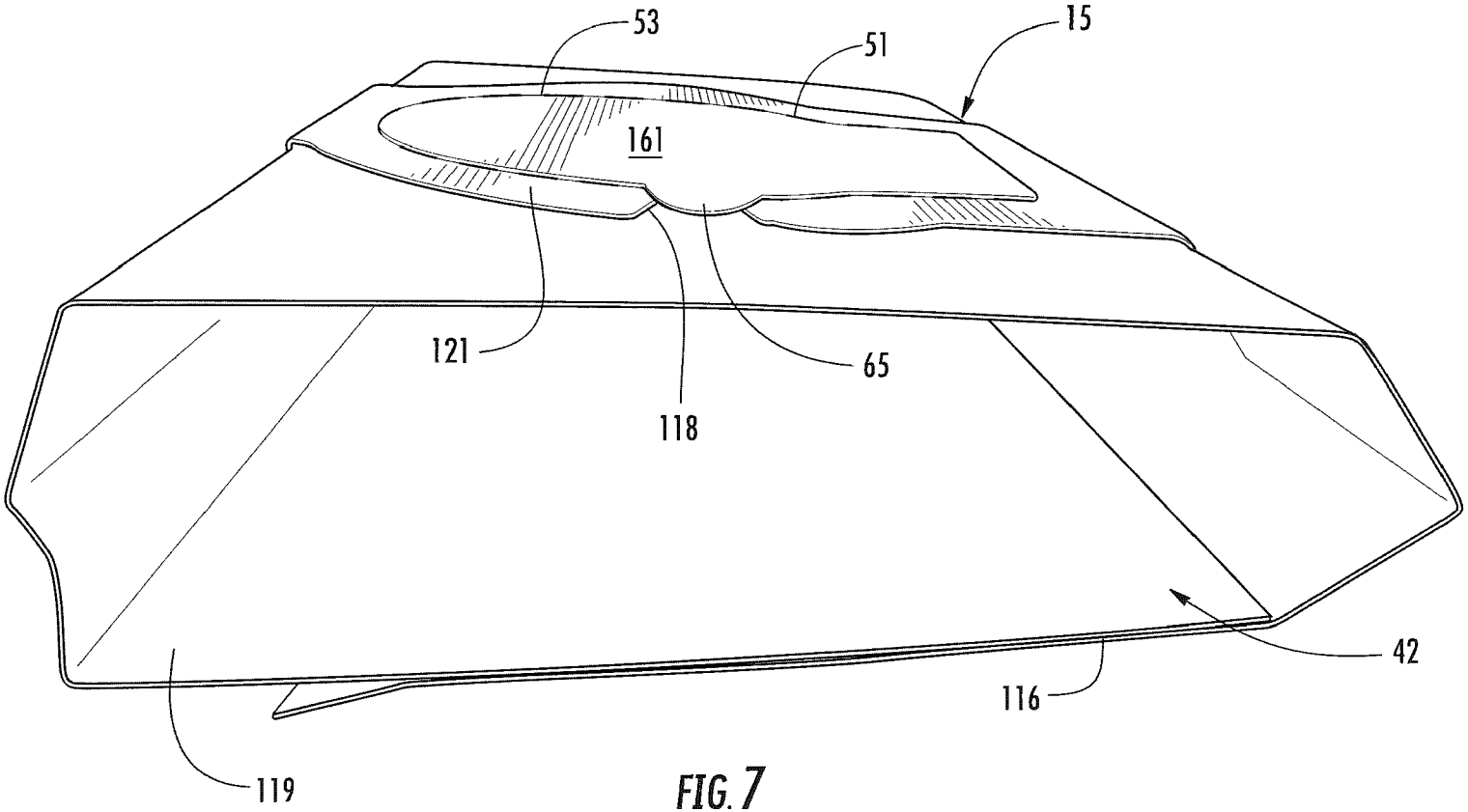
FIG. 7 is a perspective view of a sleeve formed from the blank of FIG. 5.

In another exemplary method of forming a blank 113 into the reinforced package 117, the blank 113 may be folded about fold lines 26, 28 such that the attachment flap 31 is overlapped and/or brought into registration with the bottom panel 23 and adhered to the bottom panel 23 to create a reinforcing sleeve formation 15. A bag 19 may be formed by folding the first panel 183 and the second panel 185 along fold lines 184, 86, respectively, to be in face-to-face contact. Alternatively, the bag 19 may be preformed and inserted into the sleeve and the outer dispensing feature 53 of the top panel 121 may be aligned with the inner dispensing feature 55 of the bag 19 such that the outer dispensing feature 53 circumscribes the inner dispensing feature 55. The reinforcing sleeve 15 may be attached to the bag 19 with adhesive (not shown), Upon folding the bottom panel 23 and attachment flap 31, a reinforcing package 117 exists in a first, non-erected position (e.g., substantially flat or semi-flat position), as illustrated in FIG. 6. In this first position, the individual panel portions 25A, 25B, 27A, and 27B may be generally or at least partially in face-to-face registration. The first, non-erected position illustrated reduces and/or minimizes a volume of an interior space 42 of the bag B. However, as illustrated in FIG. 6, the non-erected state may still facilitate the filling of the interior volume at least partially with a product. Thereafter, the interior volume 42 may be sealed in any feasible manner.

Figure 8:
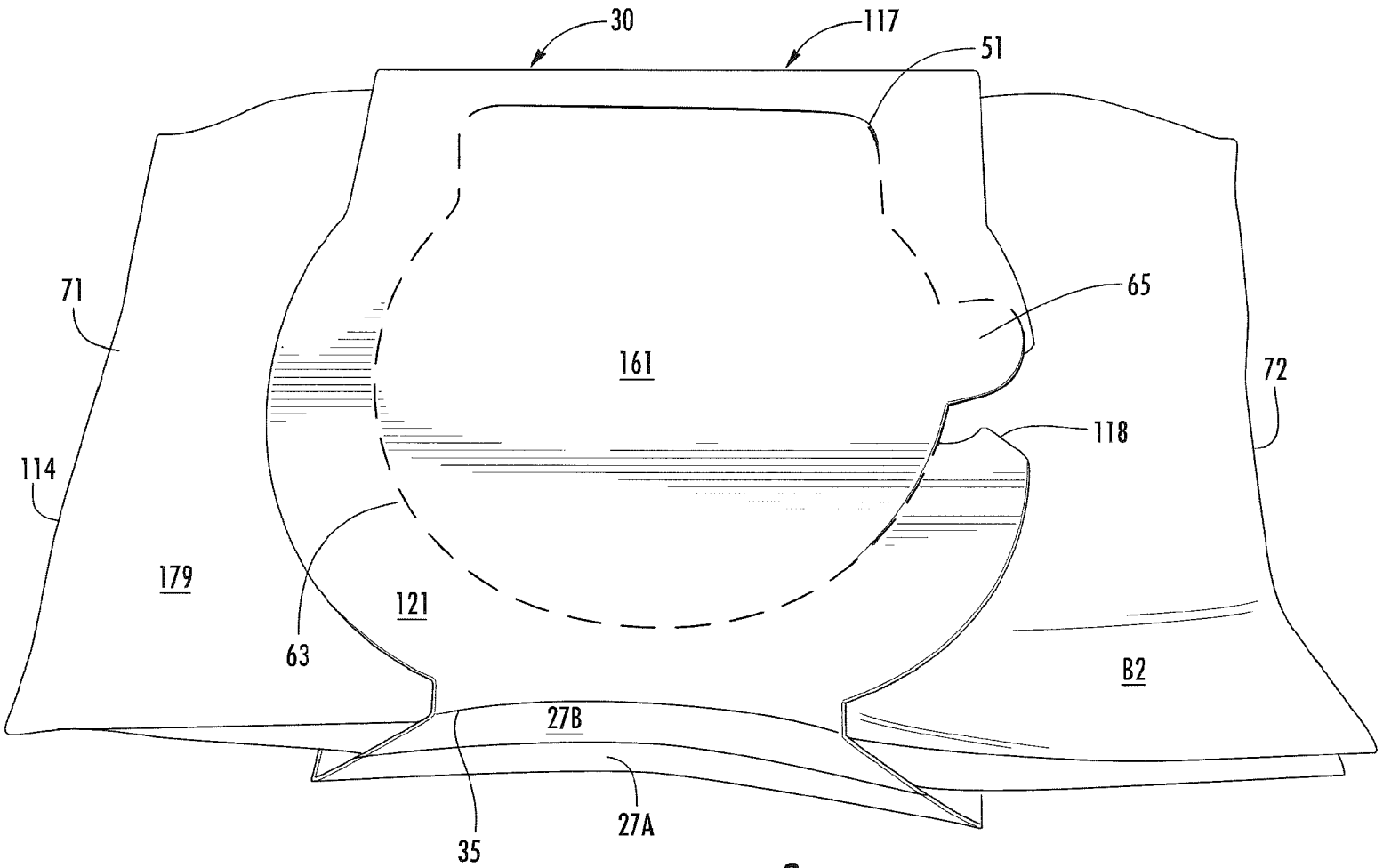
FIG. 8 is a perspective view of the carton formed from the blank of FIG. 5.

Upon receipt of a reinforced package 117 in the first, non-erected position (with or without a sealed interior volume), the individual panel portions 25A, 25B, 27A, and 27B may be flexed or positioned to form first and second sides 29, 30 of the package in a second, erected position of the package as illustrated in FIG. 8. The second, erected position, increases and/or maximizes a volume of the interior space 42.

Figure 9:
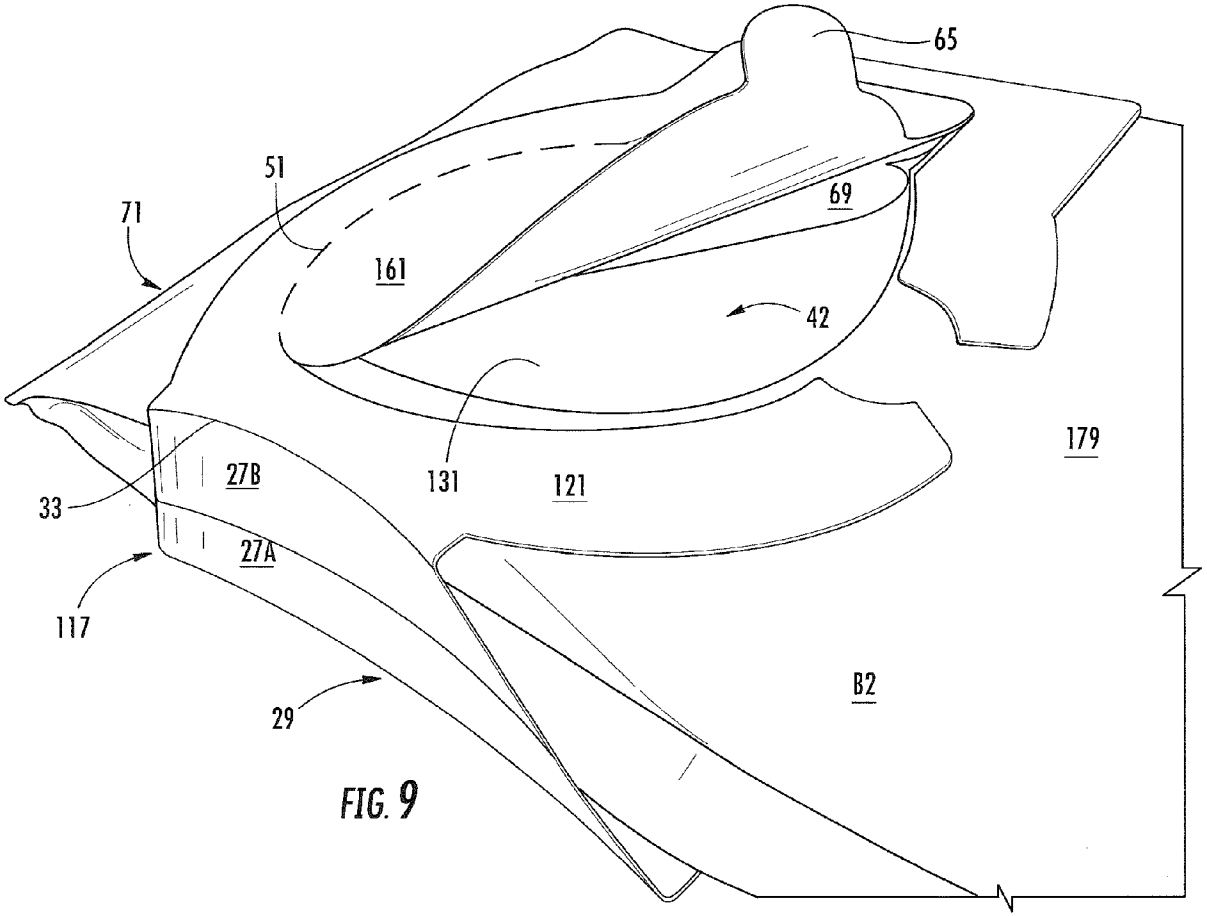
FIG. 9 is a perspective view of the carton of FIG. 8 in a partially open configuration.

As shown in FIG. 9 the dispenser 51 can be opened by grasping the access tab 65 through the cutout 118 and tearing the dispenser panel 161 and inner dispenser panel 69 along tear lines 63 and 67 to form a dispenser opening 131. Product (not shown) can be removed from the dispenser opening 131 by a consumer. Alternatively, the dispenser 51 may comprise one or more dispenser and dispenser openings or the dispenser could be otherwise configured to have one or more openings of other shapes and sizes. Further, the dispenser 51 could alternatively include one or more dispenser panels to allow the user to remove containers through dispenser opening(s) in the side panels without departing from the disclosure. Also, the dispenser 51 could comprise one or more dispenser panels that comprise at least a portion of the bottom panel 23 without departing from the disclosure.

Figure 10:
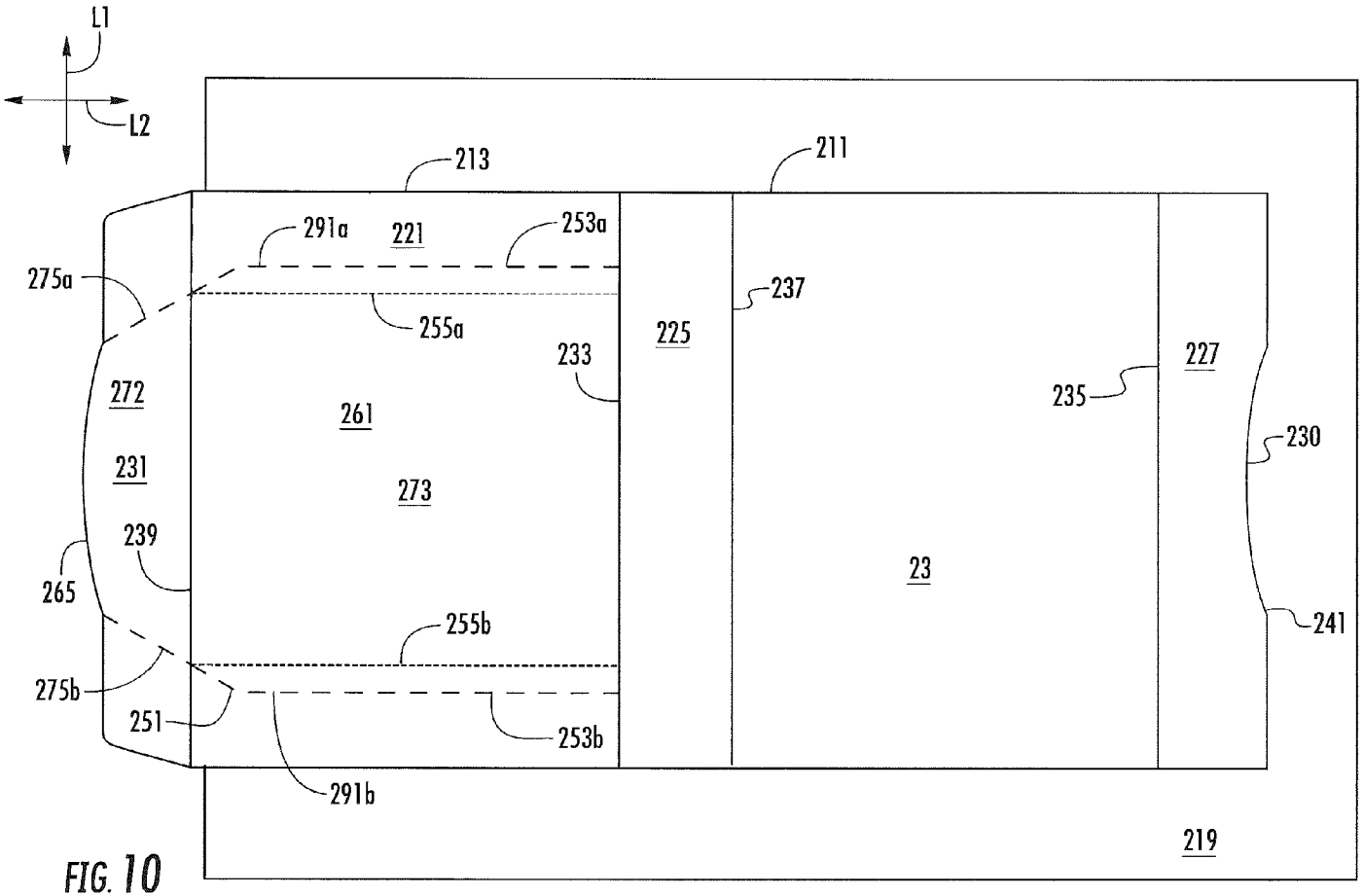
FIG. 10 is an exterior plan view of a blank for forming a carton according to another embodiment of the disclosure.

FIG. 10 is a plan view of an exterior surface 211 of a blank 213 for forming a sleeve 215 (FIG. 11) for holding a portion of liner material 219 for forming a bag in a reinforced package 217 (FIGS. 11-12), according to an embodiment of the disclosure. In the illustrated embodiment, the blank 213 has a top panel 221 foldably connected to a first side panel 225 along a first fold line 233. A bottom panel 23 is foldably connected to the first side panel 225 at a second fold line 237. A second side panel 227 is foldably connected to the bottom panel 23 along a third fold line 235. The second side panel 227 may have an arcuate notch 230 along the free edge 241. As shown in FIG. 10, an attachment flap 231 is foldably connected to the top panel 221 along a fourth fold line 239. In alternative embodiments, the blank 213 can be otherwise shaped and can have alternative panel, flap, fold line, and/or panel portion arrangements. Furthermore, according to other embodiments, the fold lines 233, 235, 237, and 239 may be otherwise shaped, arranged, or configured without departing from the disclosure.

Figure 11:
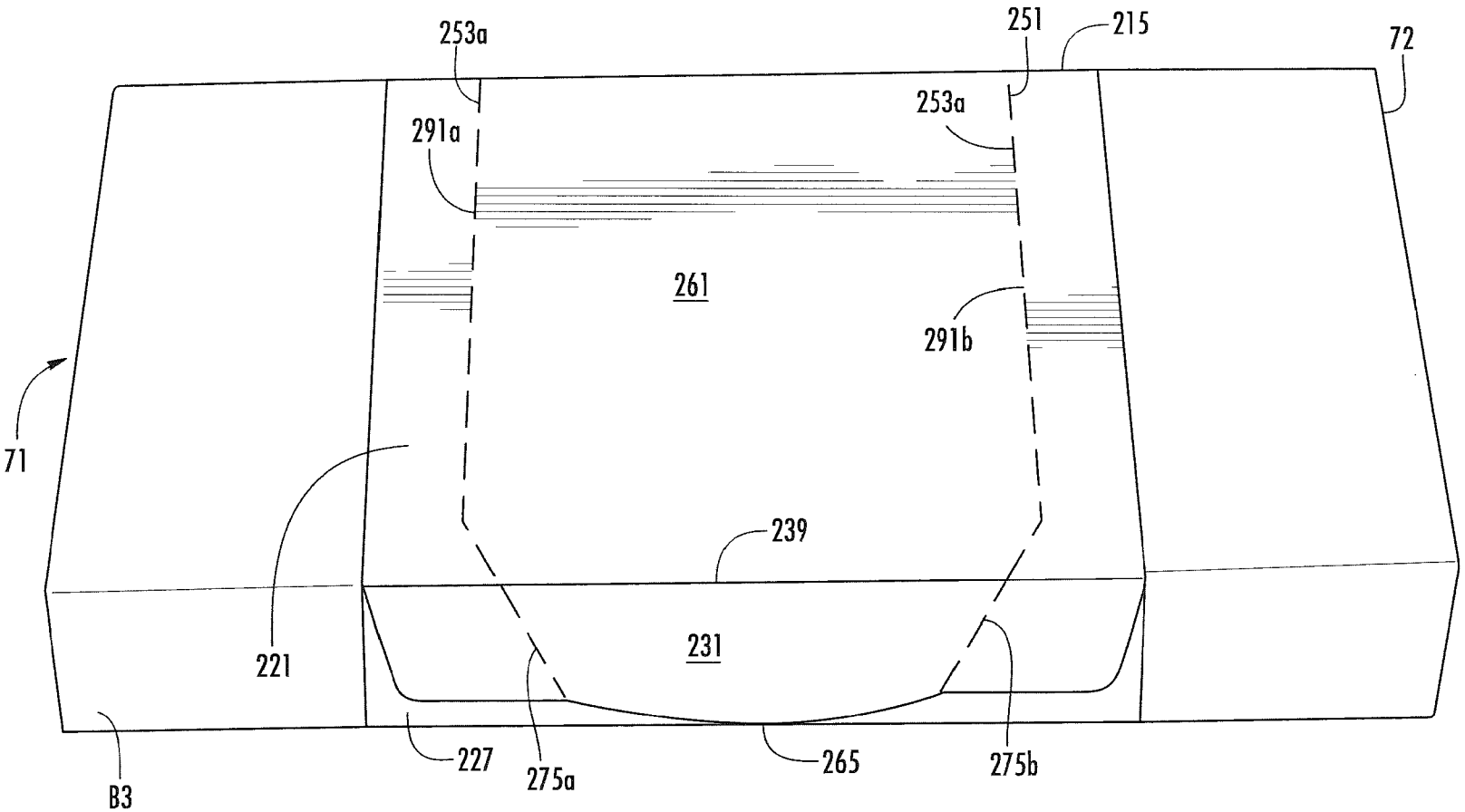
FIG. 11 is a perspective view of a sleeve formed from the blank of FIG. 10.
Figure 12:
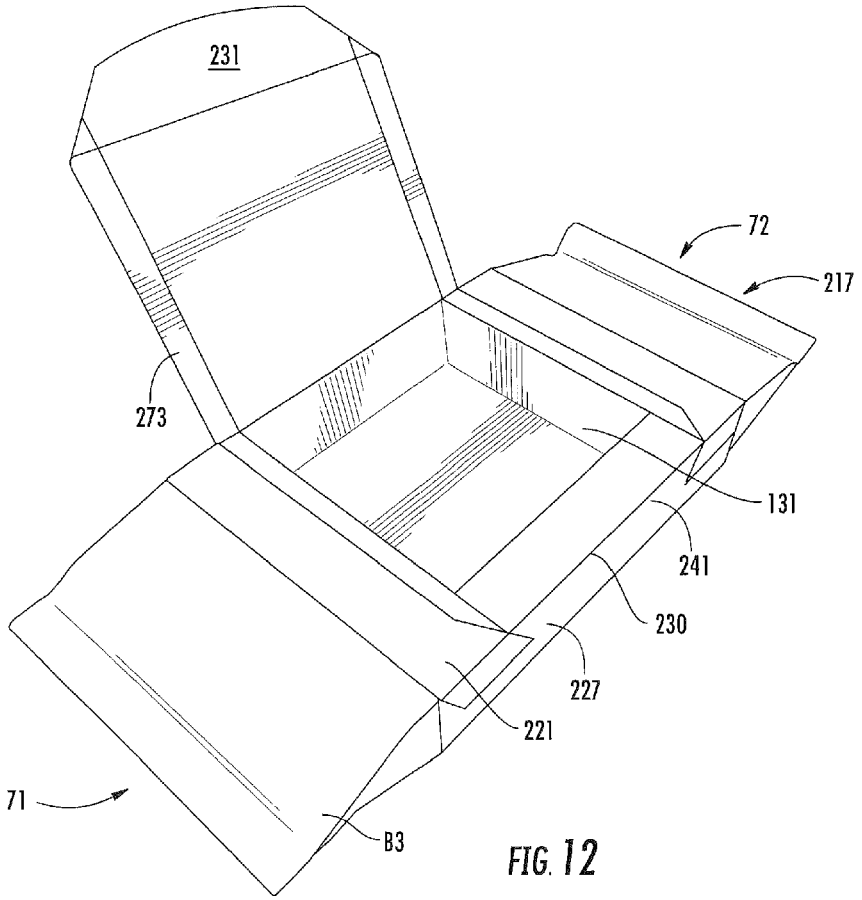
FIG. 12 is a perspective view of the carton of FIG. 11 in a partially open configuration.

As shown in FIGS. 10-12, the reinforced package 217 further includes a dispenser 251, including outer dispensing features 253*a*, 253*b* extending in the blank 213, inner dispensing feature 255*a*, 255*b* extending in the bag 24 or liner 219. The reinforced package 217 can include various dispensing features without departing from the disclosure. The outer dispensing features 253*a*, 253*b* are tear lines that define a dispenser panel 261 foldably connected to the first side panel 225 at lateral fold line 233.

In one embodiment, the dispenser panel 261 has a first portion 272 and a second portion 273. The first portion 272 is in the attachment flap 231 and defined by the edge 265 of the blank 213, the oblique portions 275*a*, 275*b* of the tear lines 253*a*, 253*b*, respectively, and a portion of the lateral fold line 239. The second portion 273 is in the top panel 221 and is at least partially defined by the oblique portions 275*a*, 275*b* of the tear lines 253*a*, 253*b* in the top panel, longitudinal tear lines 291*a*, 291*b*, and portions of fold lines 239, 233. The dispenser panel 261, including one or more of the first portion 272 and the second portion 273, could be otherwise shaped, arranged, configured without departing from the disclosure.

In one exemplary embodiment shown in FIGS. 10-12, the outer dispensing features 253*a*, 253*b* are parallel and spaced apart from the inner dispensing feature 255*a*, 255*b* along at least a portion of the respective tear lines as illustrated in FIG. 10. In other embodiments, the outer dispensing features 253*a*, 253*b* and the inner dispensing features 255*a*, 255*b* can be generally aligned or collinear. The reinforced package 217 can be assembled from blank 213 by initially adhering the liner 219 to the blank 213 and folding the second side panel 227 along fold line 235 and folding the attachment flap 231 along fold line 239 so that the attachment flap 231 overlaps the second side panel 227. The attachment flap 231 can be secured in face-to-face contact by adhesive applied either to the interior surface of the attachment flap 231 or to the exterior surface of the second side panel 227. As shown in FIG. 11, the side panels 225, 227 can be positioned relative to the top panel 221 and the bottom panel 23 to form a generally open-ended tubular sleeve 215 at least partially forming the interior space. The tubular sleeve can be filled with product (not shown) prior to closing the ends 71, 72 of the reinforced package 217, or one of the ends can be closed prior to loading the product. Once the product is loaded, the ends 71, 72 of the liner 219 can be closed to form the closed reinforced package 217.

As shown in FIG. 12, the dispenser 251 can be opened by grasping the first portion 272 of the dispenser flap and tearing the dispenser panel 261 along respective portions 275*a* 275*b*, 291*a*, and 291*b* of tear lines 253*a*, 253*b* and tear lines 255*a*, 255*b* in the liner 219 to form the dispenser opening 131. Products can be removed from the dispenser opening 131 by a consumer. Alternatively, the dispenser 251 may comprise one or more dispenser and dispenser openings or the dispenser could be otherwise configured to have one or more openings of other shapes and sizes. Further, the dispenser 251 could alternatively include one or more dispenser panels in the first side panel 225 to allow the user to remove containers through dispenser opening(s) in the other side panel without departing from the disclosure. Also, the dispenser 251 could comprise one or more dispenser panels that comprise at least a portion of the bottom panel 23 without departing from the disclosure.

In one embodiment, the liners 19, 119, and 219 may be formed of generally permeable material. The liner material can comprise paper, Kraft paper, laminated paper or any other suitable paper material without departing from the disclosure. Alternatively, the liner material could comprise a non-permeable material or layers of material and can comprise any suitable material which is relatively flexible and relatively fluid impervious. Alternatively, the liner material can comprise plastics such as polyethylene, polypropylene, polyethylene terephthalate, polystyrene, poly vinyl chloride, or any other suitable material without departing from the disclosure.

In the illustrated embodiment, the blanks 13, 113, and 213 can comprise any material which is relatively rigid such as paperboard, clay-coated paperboard, solid bleached board (SBB) paperboard, solid bleached sulphate (SBS) paperboard, Kraft line paperboard, or any other suitable material without departing from the disclosure.

Generally, as described herein, bags can be formed from a bag stock material, although various plastic or other bag materials also can be used, and can be lined or coated with a desired material. The reinforcing cartons described herein can be made from a more rigid material such as a clay-coated natural haft ("CCNK"). Other materials such various card-stock, paper, plastic or other synthetic or natural materials also can be used to form the components of the packages described herein.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure without departing from the scope of the disclosure.

What is claimed is:

1. A package for holding an article, the package comprising:

a liner and a construct attached to an exterior of the liner, the liner comprises a flexible material and an interior space for holding an article, and the construct comprises a rigid material and a plurality of panels that at least partially reinforce at a portion of the liner, the plurality of panels comprises a top panel, a bottom panel, a first side panel foldably connected to the top panel along a first fold line and foldably connected to the bottom panel along a second fold line, and a second side panel foldably connected to the top panel along a third fold line and foldably connected to an attachment panel along a fourth fold line, the bottom panel extending between the first side panel and the second side panel, and the first fold line, second fold line, third fold line, and fourth fold line are each arcuate; and a dispenser comprising dispensing features in at least one of the top panel and the bottom panel for allowing removal of the article from the interior space, the dispensing features comprise a dispenser panel at least partially defined by a tear line in the construct, the dispenser panel is for being at least partially separated from the construct along the tear line to form a dispenser opening.

2. The package of claim 1, wherein the dispenser panel is a first dispenser panel and the tear line is a first tear line; and the dispensing features comprise a second dispenser panel in the liner at least partially defined by a second tear line.

3. The package of claim 2, wherein the first dispenser panel and the second dispenser panel are aligned.

4. The package of claim 3, wherein the first dispenser panel and the second dispenser panel are in face-to-face contact.

5. The package of claim 2, wherein the first tear line is spaced apart from the second tear line.

6. The package of claim 2, wherein the first tear line and the second tear line are arcuate, and the first tear line circumscribes the second tear line.

7. The package of claim 2, wherein the first dispenser panel is at least partially defined by a fold line in the at least one of the top panel and the bottom panel.

8. The package of claim 7, wherein the first tear line extends between respective ends of the fold line.

9. The package of claim 7, wherein the fold line has a width less than the width of the top panel so that the fold line is spaced apart from edges of the construct.

10. The package of claim 7, wherein the fold line connects the one of the top panel and the bottom panel to one of the first side panel and the second side panel.

11. The package of claim 1, wherein the dispenser panel comprises an access tab.

12. The package of claim 1, wherein the first side panel comprises a first portion foldably connected to a second portion along a fifth fold line, and the second side panel comprises a third portion foldably connected to a fourth portion along a sixth fold line.

13. The package of claim 1, wherein the first dispenser panel comprises an access tab, the top panel comprises a free edge with a notch, and the access tab extends to the free edge.

14. A package for holding an article, the package comprising:

a liner and a construct attached to the liner, the liner comprises and an interior space for holding an article, and the construct comprises a plurality of panels that at least partially reinforce at a portion of the liner, the plurality of panels comprises a top panel, a first side panel, a second side panel, and a bottom panel, and a dispenser comprising dispensing features in at least one of the top panel and the bottom panel for allowing removal of the article from the package, the dispensing features comprise a dispenser panel at least partially defined by a tear line in the construct, the dispenser panel is for being at least partially separated from the construct along the tear line to form a dispenser opening, wherein the first side panel is foldably connected to the top panel along a first fold line and foldably connected to the bottom panel along a second fold line, the second side panel is foldably connected to the top panel along a third fold line and foldably connected to an attachment panel along a fourth fold line, and the attachment panel is in face-to-face contact and adhered to the bottom panel.

15. A package for holding an article, the package comprising:

a liner and a construct attached to an exterior of the liner, the liner comprises a flexible material and an interior space for holding an article, and the construct comprises a rigid material and a plurality of panels that at least partially reinforce at a portion of the liner, the plurality of panels comprises a top panel, a first side panel foldably connected to the top panel, a second side panel foldably connected to the top panel, and a bottom panel foldably connected to at least one of the first side panel and the second side panel and extending between the first side panel and the second side panel, and a dispenser comprising dispensing features in at least one of the top panel and the bottom panel for allowing removal of the article from the interior space, the dispensing features comprise a dispenser panel at least partially defined by a tear line in the construct, the dispenser panel is for being at least partially separated from the construct along the tear line to form a dispenser opening and wherein the dispenser panel comprises an access tab that extends into one of the first side panel and the second side panel.

16. A construct in combination with a liner, the combination comprising:

the construct attached to an exterior of the liner, the liner comprises a flexible material and an interior space for holding an article, and the construct comprises a rigid material and a plurality of panels that at least partially reinforce a portion of the liner, the plurality of panels comprises a top panel, a bottom panel, a first side panel foldably connected to the top panel along a first fold line and foldably connected to the bottom panel along a second fold line, a second side panel foldably connected to the top panel along a third fold line and foldably connected to an attachment panel along a fourth fold line, the bottom panel extending between the first side panel and the second side panel, and the first fold line, second fold line, third fold line, and fourth fold line are each arcuate; and a dispenser comprising dispensing features in at least one of the top panel and the bottom panel for allowing removal of the article from the interior space, the dispensing features comprise a dispenser panel at least partially defined by a tear line in the construct, the dispenser panel for being at least partially separated from the construct along the tear line to form a dispenser opening.

17. The combination of claim 16, wherein the dispenser panel is a first dispenser panel and the tear line is a first tear line; and the dispensing features comprise a second dispenser panel in the liner at least partially defined by a second tear line.

18. The combination of claim 17, wherein the first dispenser panel and the second dispenser panel are aligned.

19. The combination of claim 18, wherein the first dispenser panel and the second dispenser panel are in face-to-face contact.

20. The combination of claim 17, wherein the first tear line is spaced apart from the second tear line.

21. The combination of claim 17, wherein the first tear line and the second tear line are arcuate, and the first tear line circumscribes the second tear line.

22. The combination of claim 17, wherein the first dispenser panel is at least partially defined by a fold line in the at least one of the top panel and the bottom panel.

23. The combination of claim 22, wherein the first tear line extends between respective ends of the fold line.

24. The combination of claim 22, wherein the fold line has a width less than the width of the top panel so that the fold line is spaced apart from edges of the construct.

25. The combination of claim 22, wherein the fold line connects the one of the top panel and the bottom panel to one of the first side panel and the second side panel.

26. The combination of claim 16, wherein the dispenser panel comprises an access tab.

27. The combination of claim 16, wherein the first side panel comprises a first portion foldably connected to a second portion along a fifth fold line, and the second side panel comprises a third portion foldably connected to a fourth portion along a sixth fold line.

28. The combination of claim 16, wherein the first dispenser panel comprises an access tab, the top panel comprises a free edge with a notch, and the access tab extends to the free edge.

29. A construct in combination with a liner, the combination comprising:

the construct attached to the liner, the liner comprises an interior space for holding an article, and the construct comprises a plurality of panels that at least partially reinforce a portion of the liner, the plurality of panels comprises a top panel, a first side panel, a second side panel, and a bottom panel, and a dispenser comprising dispensing features in at least one of the top panel and the bottom panel for allowing removal of the article from the combination, the dispensing features comprise a dispenser panel at least partially defined by a tear line in the construct, the dispenser panel for being at least partially separated from the construct along the tear line to form a dispenser opening, wherein the first side panel is foldably connected to the top panel along a first fold line and foldably connected to the bottom panel along a second fold line, the second side panel is foldably connected to the top panel along a third fold line and foldably connected to an attachment panel along a fourth fold line, and the attachment panel is in face-to-face contact and adhered to the bottom panel.

30. A construct in combination with a liner, the combination comprising:

the construct attached to an exterior of the liner, the liner comprises a flexible material and an interior space for holding an article, and the construct comprises a rigid material and a plurality of panels that at least partially reinforce a portion of the liner, the plurality of panels comprises a top panel, a first side panel foldably connected to the top panel, a second side panel foldably connected to the top panel, and a bottom panel foldably connected to at least one of the first side panel and the second side panel and extending between the first side panel and the second side panel, and a dispenser comprising dispensing features in at least one of the top panel and the bottom panel for allowing removal of the article from the interior space, the dispensing features comprise a dispenser panel at least partially defined by a tear line in the construct, the dispenser panel for being at least partially separated from the construct along the tear line to form a dispenser opening and the dispenser panel comprise an access tab that extends into one of the first side panel and the second side panel.

31. A method of forming a package, the method comprising:

obtaining a construct comprising a rigid material and a liner comprising a flexible material, the construct comprising a plurality of panels, the plurality of panels comprises a top panel, a bottom panel, a first side panel foldably connected to the top panel along a first fold line and foldably connected to the bottom panel along a second fold line, a second side panel foldably connected to the top panel along a third fold line and foldably connected to an attachment flap along a fourth fold line, the first, second, third, and fourth fold lines are each arcuate; and a dispenser comprising dispensing features in at least one of the top panel and the bottom panel for allowing removal of an article from the package, the dispensing features comprise a dispenser panel at least partially defined by a tear line in the construct;

attaching the construct to an exterior of the liner;

forming an interior space of the package at least partially defined by the plurality of panels, the bottom panel extending between the first side panel and the second side panel and being spaced apart from the top panel to define the interior space; and forming a dispenser opening by tearing along the tear line and at least partially separating the dispenser panel from the construct.

32. The method of claim 31, wherein the dispenser panel is a first dispenser panel and the tear line is a first tear line; and the dispensing features comprise a second dispenser panel in the liner at least partially defined by a second tear line.

33. The method of claim 32, wherein the method further comprises aligning the first dispenser panel and the second dispenser panel.

34. The method of claim 33, wherein the first dispenser panel and the second dispenser panel are in face-to-face contact.

35. The method of claim 32, wherein the first tear line is spaced apart from the second tear line.

36. The method of claim 32, wherein the first tear line and the second tear line are arcuate, and the first tear line circumscribes the second tear line.

37. The method of claim 32, wherein the first dispenser panel is at least partially defined by a fold line in the at least one of the top panel and the bottom panel.

38. The method of claim 31, wherein the first side panel comprises a first portion foldably connected to a second portion along a fifth fold line, and the second side panel comprises a third portion foldably connected to a fourth portion along a sixth fold line.

39. A method of forming a package, the method comprising:

obtaining a construct, the construct comprising a plurality of panels, the plurality of panels comprises a top panel, a first side panel, a second side panel, and a bottom panel, and a dispenser comprising dispensing features in at least one of the top panel and the bottom panel for allowing removal of an article from the package, the dispensing features comprise a dispenser panel at least partially defined by a tear line in the construct;

attaching the construct to a liner;

forming an interior space of the package at least partially defined by the plurality of panels; and forming a dispenser opening by tearing along the tear line and at least partially separating the dispenser panel from the construct, wherein the first side panel is foldably connected to the top panel along a first fold line and foldably connected to the bottom panel along a second fold line, the second side panel is foldably connected to the top panel along a third fold line and foldably connected to an attachment panel along a fourth fold line, and the attachment panel is in face-to-face contact and adhered to the bottom panel.

* * * * *